US008502126B2

(12) United States Patent
Tyree

(10) Patent No.: US 8,502,126 B2
(45) Date of Patent: Aug. 6, 2013

(54) SYSTEM AND METHOD FOR NAVIGATING AN OBJECT

(75) Inventor: Anthony K. Tyree, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 284 days.

(21) Appl. No.: 12/789,172

(22) Filed: May 27, 2010

(65) Prior Publication Data

US 2011/0290932 A1 Dec. 1, 2011

(51) Int. Cl.
*F42B 15/01* (2006.01)
*F42B 15/00* (2006.01)

(52) U.S. Cl.
USPC ..... 244/3.15; 244/3.1

(58) Field of Classification Search
USPC ..... 244/3.1–3.3, 34 R, 35 R, 45 R, 45 A, 244/46, 53 R, 55, 75.1, 87, 117 R, 129.1, 244/130, 198, 200, 200.1; 60/200.1, 204
See application file for complete search history.

(56) References Cited

U.S. PATENT DOCUMENTS 2,824,711 A * 2/1958 Porter ..... 244/3.21
2,980,370 A * 4/1961 Takacs ..... 244/130
3,680,816 A * 8/1972 Mello ..... 244/46
3,971,535 A * 7/1976 Jones ..... 244/46
4,132,375 A * 1/1979 Lamar ..... 244/46
4,538,779 A * 9/1985 Goldstein ..... 244/87
4,623,107 A * 11/1986 Misoph ..... 244/3.22
4,674,707 A * 6/1987 Kranz ..... 244/3.22
4,793,571 A * 12/1988 Kranz ..... 244/3.1
4,809,929 A * 3/1989 August ..... 244/3.28
5,031,857 A * 7/1991 MacConochie et al. ..... 244/3.28
5,102,072 A * 4/1992 Egan et al. ..... 244/3.21
5,143,320 A * 9/1992 Boyadjian ..... 244/3.21
5,150,858 A * 9/1992 Hopwell et al. ..... 244/45 A
5,495,999 A * 3/1996 Cymara ..... 244/45 A
5,529,263 A * 6/1996 Rudolph ..... 244/55
5,564,652 A * 10/1996 Trimbath ..... 244/3.27
5,590,520 A * 1/1997 Papamoschou ..... 60/204
5,598,990 A * 2/1997 Farokhi et al. ..... 244/200.1
5,651,516 A * 7/1997 Mihora et al. ..... 244/3.24
5,676,333 A * 10/1997 Rethorst ..... 244/130
6,502,785 B1 * 1/2003 Teter et al. ..... 244/3.22
6,513,754 B1 * 2/2003 Grove ..... 244/130
6,601,795 B1 * 8/2003 Chen ..... 244/46
6,614,012 B2 * 9/2003 Schneider et al. ..... 244/3.1
6,651,935 B2 * 11/2003 Loth et al. ..... 244/198
7,278,609 B2 * 10/2007 Arata ..... 244/130
7,392,963 B1 * 7/2008 Leek et al. ..... 244/3.13
7,645,969 B2 * 1/2010 Gnemmi et al. ..... 244/3.1
7,775,480 B2 * 8/2010 Schulein ..... 244/130
7,795,567 B2 * 9/2010 Schneider ..... 244/3.26

* cited by examiner

*Primary Examiner* — Bernarr Gregory
(74) *Attorney, Agent, or Firm* — Schwegman Lundberg & Woessner, P.A.

(57) ABSTRACT

One example embodiment relates to a navigation system for a guided projectile. The navigation system includes a detector within the guided projectile. The detector determines an actual amount of time it takes after launch for the guided projectile to accelerate through mach one. The navigation system further includes a guidance system within the object. The guidance system includes a projected flight plan for the guided projectile. The projected flight plan includes an estimated amount of time after launch it will take the object to accelerate through the speed of sound. The guidance system compares the actual amount of time and the estimated amount of time and adjusts the flight path of the guided projectile based on data received from the detector.

7 Claims, 8 Drawing Sheets

| | | |
|---|---|---|
| 0.692 | km | PROJECTILE ALTITUDE |
| 26.0 | °C | MET TEMP @ 685 m ALTITUDE |
| 346.9 | SOS M/S | ESTIMATED SOS AT ALTITUDE |
| 347.3 | M/S | * VELOCITY ERROR @ 3.887 SEC |
| -0.4 | M/S | RADAR SPEED @ 3.887 SEC |
| * RADAR TRUTH HAS AN RMS ERROR OF ~ 1 M/S | | |

SYSTEM AND METHOD FOR NAVIGATING AN OBJECT

TECHNICAL FIELD

Embodiments pertain to a system and method for detecting when an object accelerates through mach one.

BACKGROUND

An accurate determination of velocity is critical in order to navigate objects such as projectiles and missiles to a desired point in space. Existing systems and methods often use a GPS receiver to determine velocity. However, GPS systems add to the cost of producing projectiles and missiles. In addition, many projectiles and/or missiles are used in applications where the mission timelines are too short to use GPS.

When GPS or other direct means of measurement (i.e., pressure transducer, Doppler radar) are unavailable or undesirable for whatever reason, the initial velocity must be estimated in order to properly operate a guidance system that navigates the object. One method of estimating the initial velocity of a projectile or missile is to characterize the launch velocity versus the temperature of the object's propellant charge and/or the launch chamber pressure.

Accurately estimating the velocity is crucial in applications where precise navigation is required for long range target engagements with objects such as guided projectiles, bombs and missiles. One of the drawbacks with existing systems and methods that estimate velocity is that the accuracy of these estimates often suffers due to external considerations that cannot be accounted for during actual operation of the object. As an example, many known projectiles typically have a substantial variation in propellant characteristics from round to round. This variation usually causes high variability in exit tube velocity (i.e., up to 10 m/s).

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

The systems and methods described herein establish the velocity of a missile or projectile at a point in time by detecting when the missile or projectile accelerates through the speed of sound. In addition, when atmospheric conditions are known (primarily air temperature) the system and method may calculate the velocity of the missile or projectile when the missile or projectile accelerates through the speed of sound transition. This information relating to the object's velocity at a specific point in time may be provided to a guidance system (e.g., an Inertial Measurement Unit) on the object which utilizes the information to navigate the object.

As used herein, an object that accelerates through the speed of sound refers to a guided projectile, projectile, missile, mortar, bomb, plane, spacecraft or any other device that accelerates through mach one.

Figure 1:
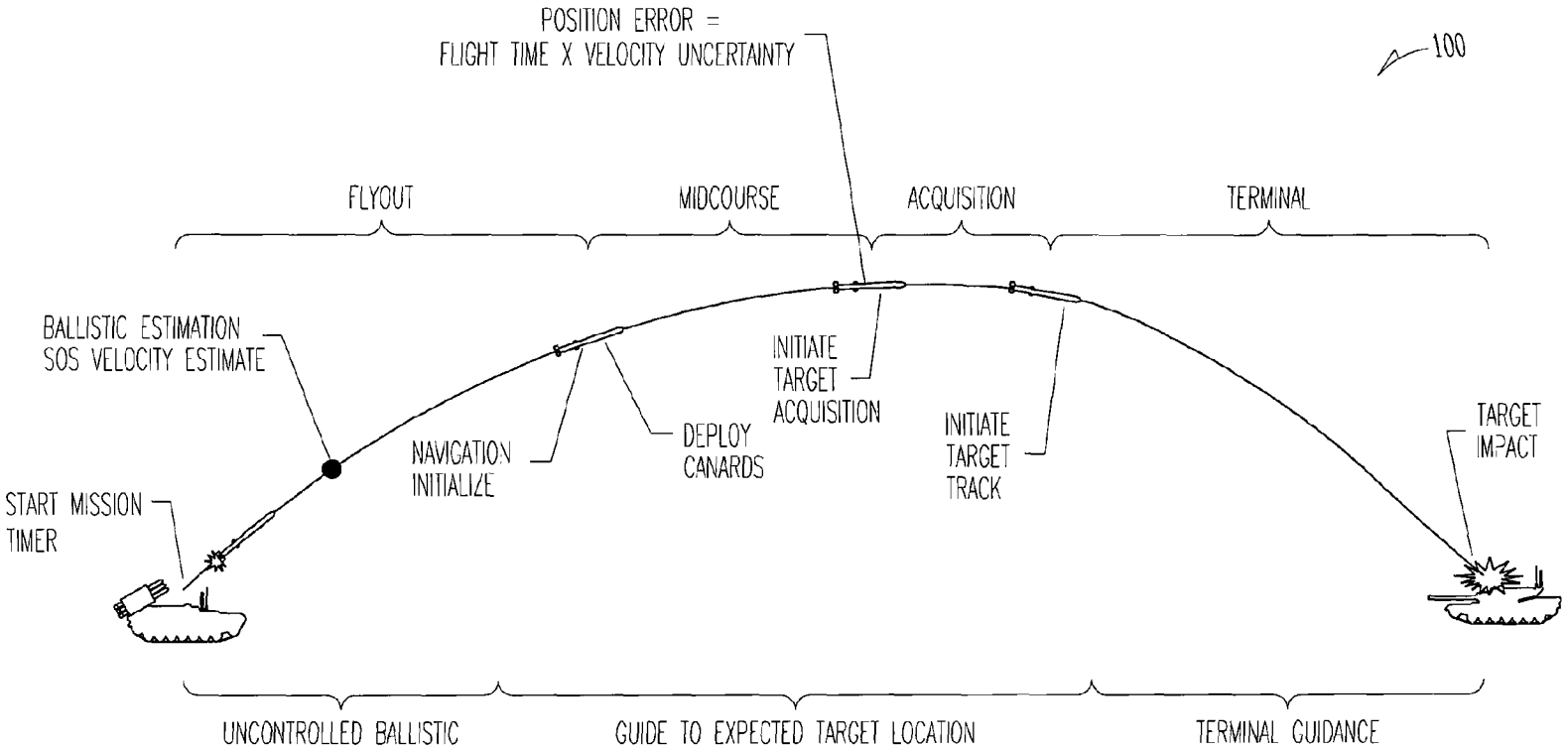
FIG. 1 illustrates an example projectile engagement scenario where the projectile exceeds mach one during flight.

FIG. 1 illustrates an example projectile engagement scenario 100 where the projectile exceeds mach one during flight. It should be noted that the projectile typically accelerates through mach one in the fly-out phase of the projectile engagement scenario.

Figure 2:
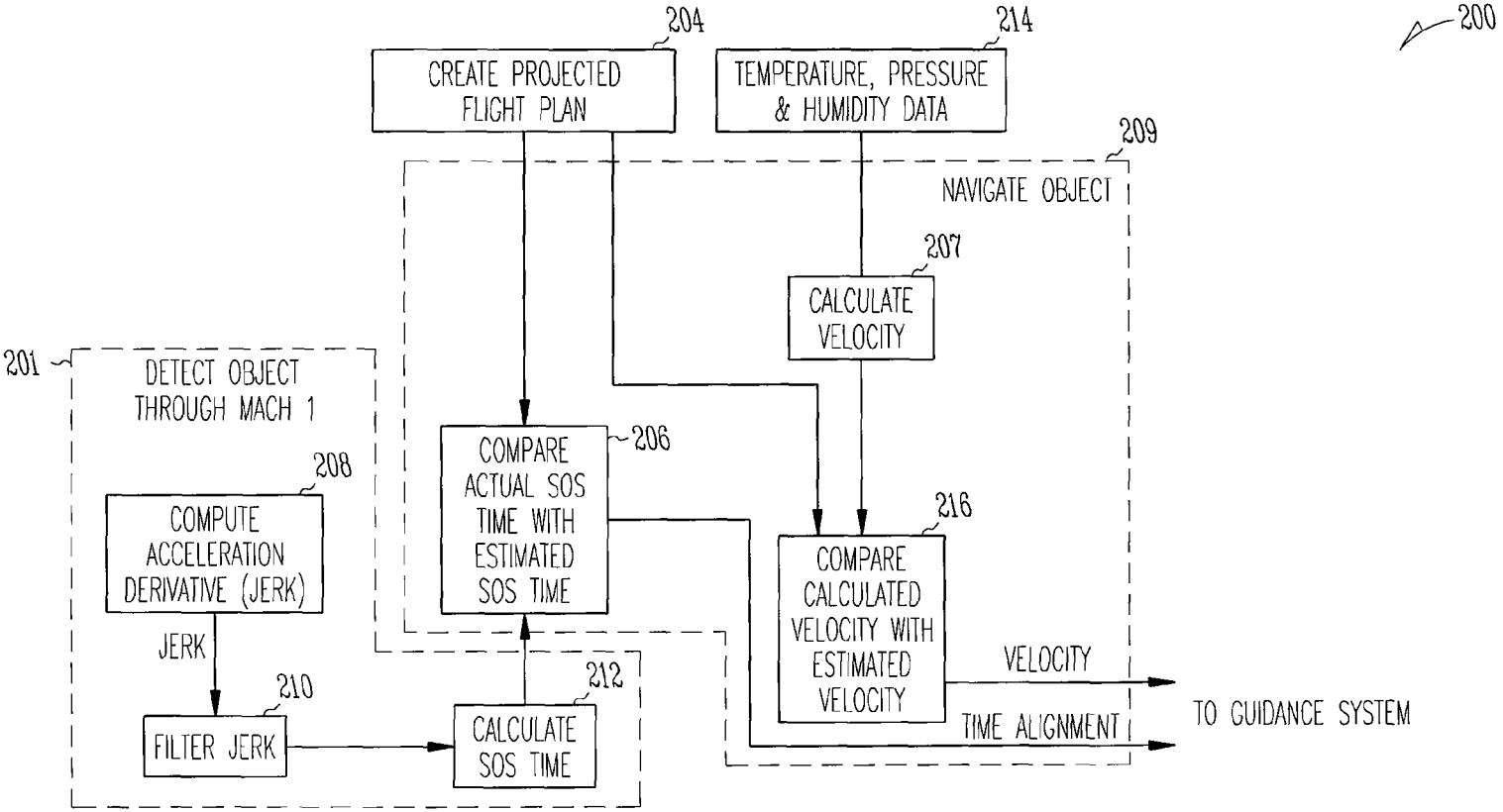
FIG. 2 illustrates a flow diagram of an example method of detecting when an object accelerates through mach one.

FIG. 2 illustrates a flow diagram of an example method 200 of navigating an object. The method 200 includes [201] detecting when the object accelerates through the speed of sound and [209] maneuvering the object based on when the object accelerates through the speed of sound.

The method 200 may further include [207] calculating the velocity at which the object is moving when the object accelerates through the speed of sound. In some embodiments, [207] calculating the velocity at which the object is moving when the object accelerates through the speed of sound includes [214] determining the temperature of an environment that the object is traveling through. In addition, the accuracy of the velocity calculation may be improved by also [214] determining the humidity, pressure and air density of the environment that the object is traveling through.

The method 200 may further include [204] creating a projected flight plan for the object where the projected flight plan includes an estimate as to how long after launch the object will accelerate through the speed of sound and at what velocity the object will be traveling as the object accelerates through the speed of sound. In some embodiments, [209] maneuvering the object based on when the object accelerates through the speed of sound includes [206] comparing the measured time the object accelerates through the speed of sound with the estimated time the object was supposed to accelerate through the speed of sound.

In addition, [209] maneuvering the object based on when the object accelerates through the speed of sound may also include [216] comparing the measured velocity of the object as the object accelerates through the speed of sound with the estimated velocity that the object was supposed to be traveling when the object accelerated through the speed of sound and adjusting the flight of the object.

In some embodiments, [201] detecting when the object accelerates through the speed of sound includes measuring the acceleration of the object (e.g., with an accelerometer). It should be noted that any known method of measuring the acceleration of the object may be used in the method 200.

In the example embodiment illustrated in FIG. 2, [201] detecting when the object accelerates through the speed of sound includes (i) [208] computing the jerk of the object during flight based on the measured acceleration; (ii) [210] filtering the jerk; and (iii) [212] calculating the speed of sound transition time based on the filtered jerk.

Figure 3:
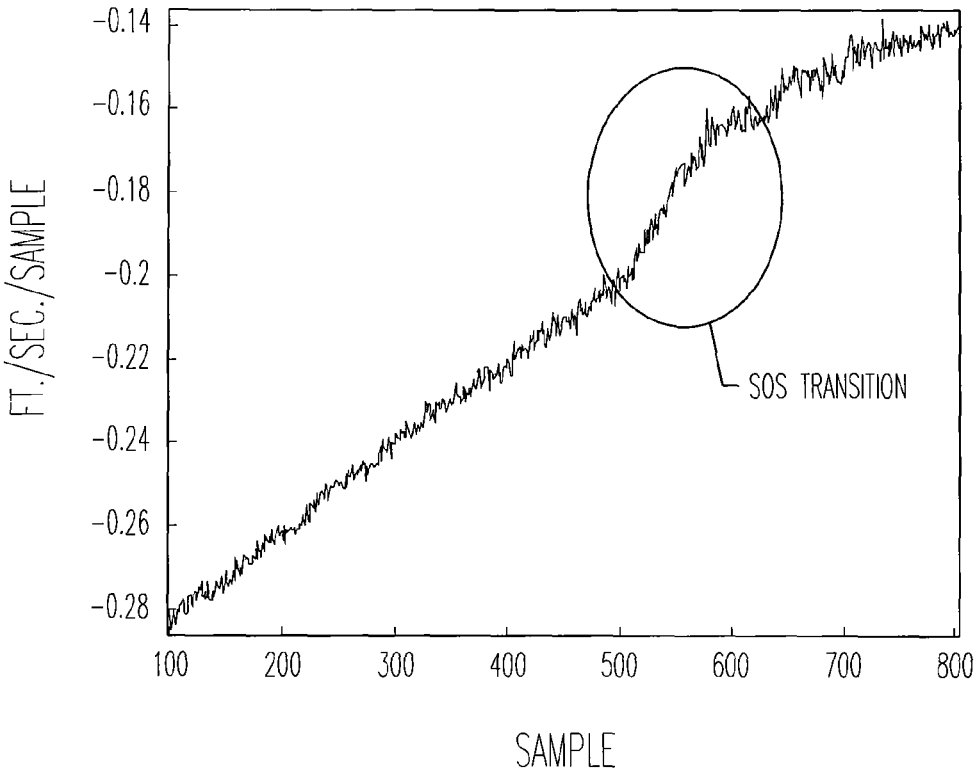
FIG. 3 illustrates example acceleration data that may be collected during a flight of an object that accelerates through mach one.

FIG. 3 shows example acceleration data that may be obtained by an accelerometer measurement located along the projectile body centerline (i.e., x-axis). The plot shows that the rate of changing acceleration is altered as the object accelerates through mach one. This alteration is indentified in FIG. 3 as an SoS transition.

Figure 4:
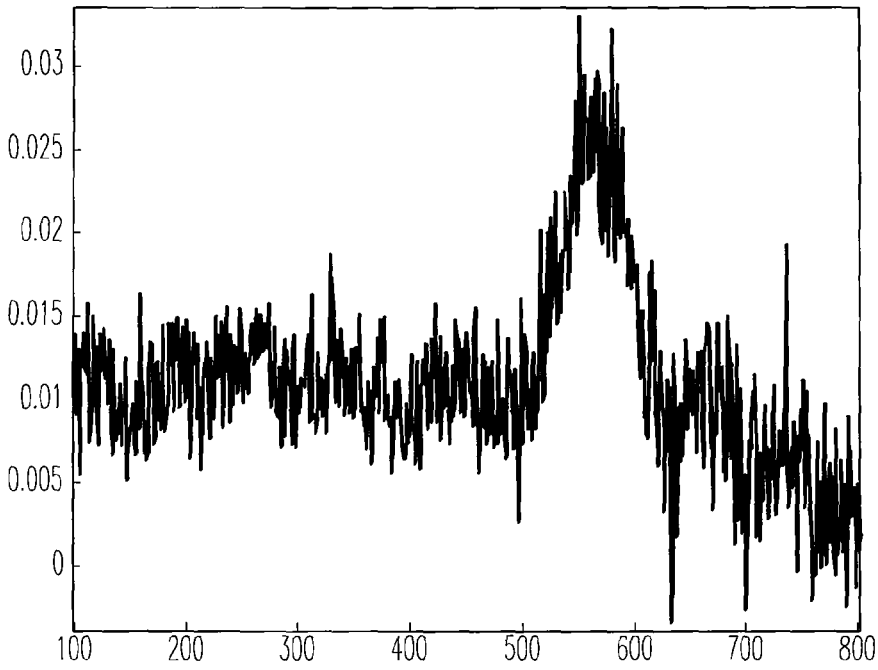
FIG. 4 illustrates an example plot of jerk data that may be created from the data shown in FIG. 3.

FIG. 4 shows a plot identifying the derivative of acceleration (i.e., jerk) that was calculated based on the data shown in FIG. 3. The jerk provides an indication as to when the projectile passes through the speed of sound transition (discussed more below). The jerk may be calculated with a digital difference algorithm. In some embodiments, the jerk may be determined more accurately by selecting the appropriate period (m) to determine the jerk. As an example, the period (m) may be chosen to be approximately the number of time samples that are necessary to transition through the speed of sound.

Figure 5:
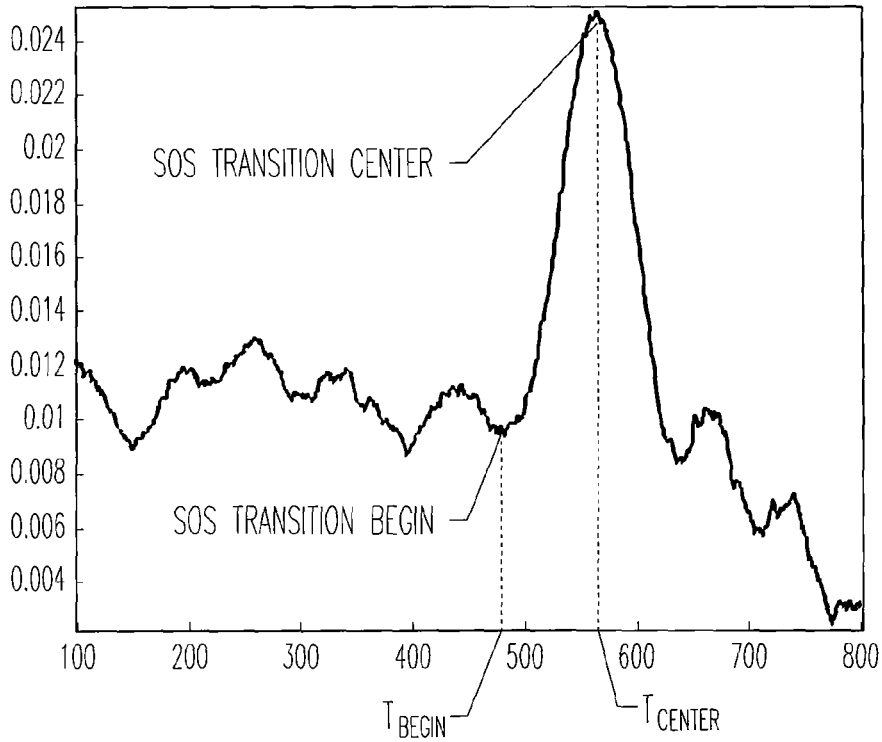
FIG. 5 illustrates an example plot of the jerk data shown in FIG. 4 where the jerk data has been filtered.

As shown in FIG. 5, the data in FIG. 4 may be filtered to improve the signal-to-noise ratio. Improving the signal-to-noise ratio enhances the ability to determine jerk within the object and as result improves accuracy when calculating the speed of sound transition time. It should be noted that the number of samples may be increased with a higher bandwidth accelerometer and/or higher sampling rate. In some embodiments, a small delay (c/2) is accepted for the added accuracy achieved for speed of sound transition time measurements ($T_{Center}$ and $T_{Begin}$):

$$\text{Jerk_Filter}(n)=\text{mean}(\text{Jerk}(n-c/2:n+c/2)).$$

Figure 6:
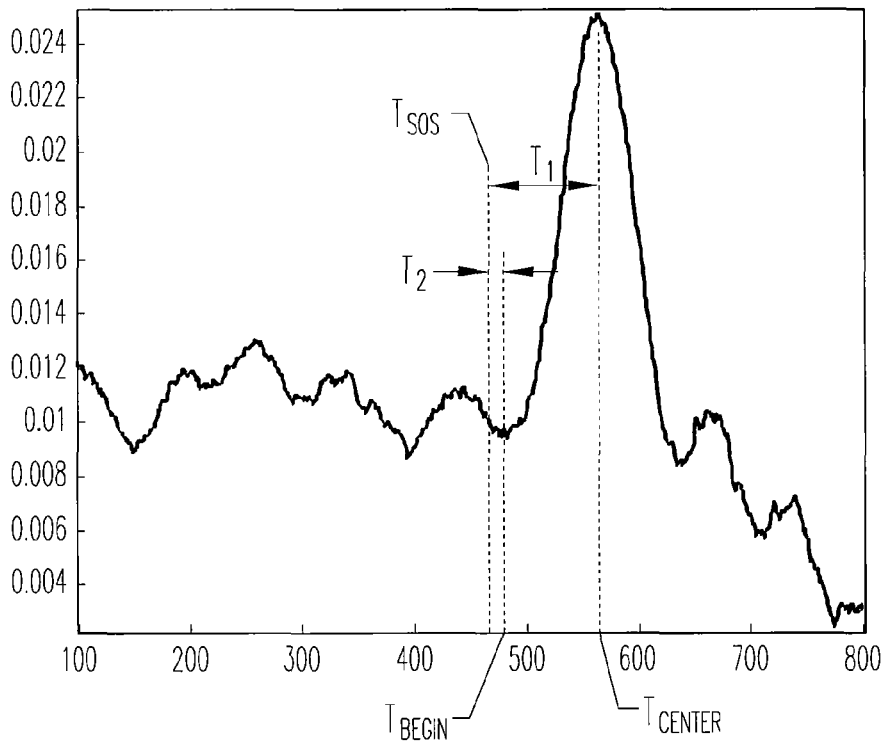
FIG. 6 illustrates the example plot shown in FIG. 5 and includes data that may be used in determining the time at which the object accelerates through mach one.

FIG. 6 shows a proof as to how to empirically develop and verify the speed of sound transition time and jerk relationship. It can be shown that the delay $T_2$ from $T_{Begin}$ to the time of the speed of sound transition is near constant. In addition, it can be shown that the delay $T_1$ from $T_{Center}$ to time of the center of the speed of sound transition is also near constant. In some embodiments, a weighted average is developed to minimize any time errors associated with acceleration through mach one such that $$T_{SoS}=(W_1\cdot(T_{Center}-T_1)+W_2\cdot(T_{Begin}-T_2))/(W+W_2).$$

As is well known, the speed of sound velocity may be estimated with temperature only as a variable by using the equation:

$$V_{SoS}=331.5*\sqrt{1+T/273.15}$$

Pressure, humidity and air density can also be used, if known, for a more accurate calculation of $V_{SoS}$.

Figure 7:
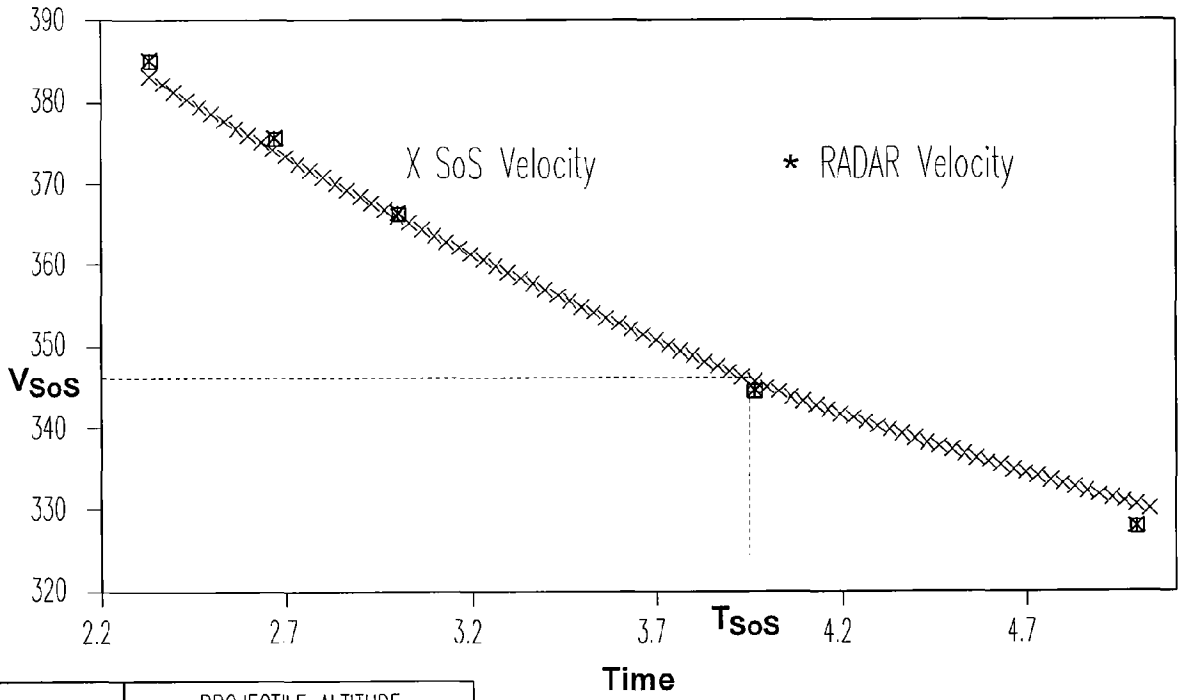
FIG. 7 shows a plot of a projectile's velocity versus time as measured by radar as well as results for one example projectile test conducted using the example systems and methods described herein.

FIG. 7 shows a plot of a projectile's velocity versus time as measured by radar as well as results for one example projectile test. The calculated $T_{SoS}$, $V_{SoS}$ have been added to the plot from integrated accelerometer measurements that are used with the example systems and methods described herein.

Figure 8:
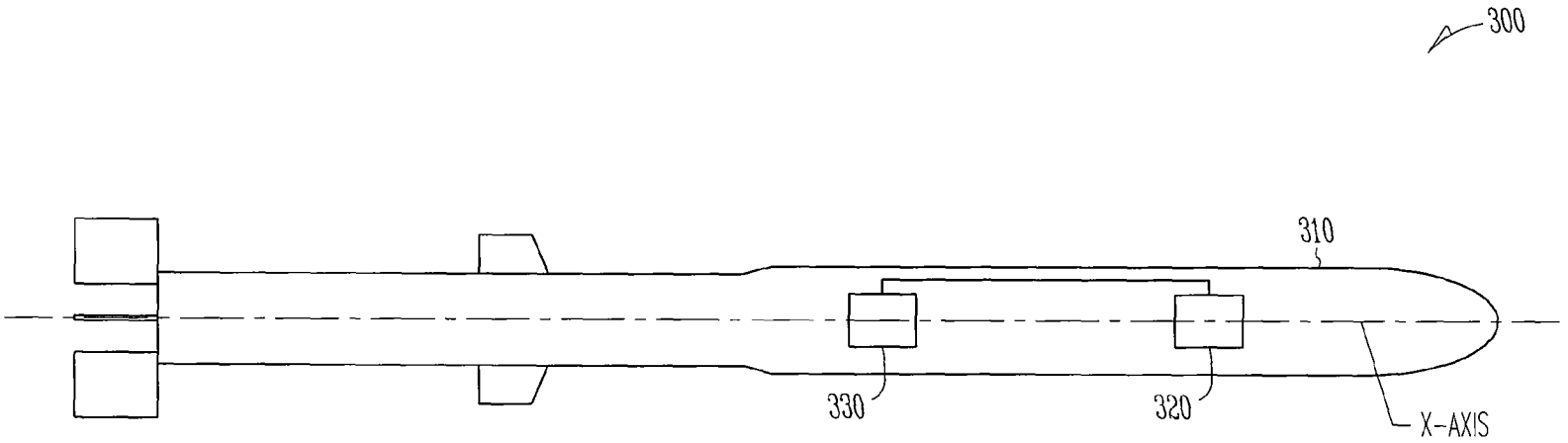
FIG. 8 shows an example system for determining when an object accelerates through mach one during flight.

FIG. 8 shows an example system 300 for navigating an object 310. The system 300 includes a detector 320 within the object 310. The detector 320 determines when the object 310 accelerates through mach one. The system 300 further includes a guidance system 330 within the object 310. The guidance system 330 adjusts the flight of the object 310 based on data received from the detector 320.

In some embodiments, the detector 320 is an inertial measurement unit 320 that includes an accelerometer which measures acceleration of the object 310 during flight. It should be noted that the accelerometer is preferably located along an x-axis of the object 310. In addition, as described above with regard to FIG. 4, the inertial measurement unit 320 determines the jerk of the object 310 during flight. The inertial measurement unit 320 may then filter the measured jerk (see, e.g., plot shown in FIG. 5) before determining the time when the object 310 accelerates through the speed of sound based on the filtered jerk (see FIG. 6).

Based on the measured time that the inertial measurement unit 320 determines the object 310 accelerates through the speed of sound, the guidance system 330 adjusts the flight of the object 310 in order to direct the object 310 to a desired location. It should be noted that in some embodiments, the guidance system 330 may also adjust the flight of the object 310 based on a calculated velocity that is obtained from the inertial measurement unit 320 and the calculated speed of sound. Providing the calculated velocity to the guidance system 330 is beneficial to navigating the object 310 because the speed of sound varies depending on the temperature, pressure, humidity and air density of the environment where the object 310 is traveling.

The systems and methods described herein may be used with guided projectiles and missiles that attain velocities greater than the speed of sound and are used in relatively long time line missions. The systems and methods are able to monitor the physical phenomenon of an object accelerating through mach one in order to facilitate navigation of an object by determining the velocity of the object at a point in time (i.e., when the object accelerates through mach one) without using GPS or radar.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A navigation system for a guided projectile, the navigation system comprising:

a detector within the guided projectile, wherein the detector determines an actual amount of time it takes after launch for the guided projectile to accelerate through mach one; and a guidance system within the object, wherein the guidance system includes a projected flight plan for the guided projectile, the projected flight plan including an estimated amount of time after launch it will take the object to accelerate through mach one, wherein the guidance system compares the actual amount of time and the estimated amount of time and adjusts the flight path of the guided projectile based on data received from the detector.

2. The navigation system of claim 1 wherein the detector determines an actual velocity that the guided projectile is traveling at as the guided projectile accelerates through mach one, and wherein the projected flight plan includes an estimated velocity that the guided projectile will be traveling at as the guided projectile accelerates through mach one, and wherein guidance system compares the actual velocity and the estimated velocity and adjusts the flight path of the guided projectile based on data received from the detector.

3. The navigation system of claim 2 wherein the detector determines the actual velocity that the guided projectile is traveling at as the guided projectile accelerates through mach one by determining a temperature of an environment that the guided projectile is traveling through.

4. The navigation system of claim 3 wherein the detector determines the actual velocity that the guided projectile is traveling at as the guided projectile accelerates through mach one by determining humidity, pressure and air density of the environment that the guided projectile is traveling through.

5. The navigation system of claim 1 wherein the detector is an inertial measurement unit that includes an accelerometer which measures acceleration of the guided projectile during flight.

6. The navigation system of claim 5 wherein the inertial measurement unit calculates jerk of the guided projectile during flight based on the measured acceleration of the guided projectile during flight.

7. The navigation system of claim 6 wherein the inertial measurement unit determines the actual amount of time it takes after launch for the guided projectile to accelerate through mach one based on the jerk of the guided projectile.

* * * * *